US006572247B2

(12) United States Patent
Liu

(10) Patent No.: US 6,572,247 B2
(45) Date of Patent: Jun. 3, 2003

(54) BULB SHADE

(76) Inventor: Yu-Peng Liu, 2nd Floor, No. 51, Lane 629, Nei-Hu Road, Sec. 1, Nei-Hu Dist, Teipei (TW)

( * ) Notice: Subject to any disclaimer, the term of this patent is extended or adjusted under 35 U.S.C. 154(b) by 18 days.

(21) Appl. No.: 10/036,513

(22) Filed: Jan. 7, 2002

(65) Prior Publication Data

US 2002/0089854 A1 Jul. 11, 2002

(30) Foreign Application Priority Data

Jan. 8, 2001 (CN) ..... 90200291 U

(51) Int. Cl.[7] ..... F21V 3/00

(52) U.S. Cl. ..... 362/311; 362/353; 362/363; 362/378; 362/439

(58) Field of Search ..... 362/311, 353, 362/363, 378, 439

(56) References Cited

U.S. PATENT DOCUMENTS 1,006,805 A * 10/1911 Thomson ..... 362/376
2,339,385 A * 1/1944 Dupler ..... 362/363
4,118,762 A * 10/1978 Fennell ..... 362/311
4,477,864 A * 10/1984 Van Duyn et al. ..... 362/363
5,034,869 A * 7/1991 Choi ..... 362/363
5,113,329 A * 5/1992 Lin ..... 362/238
5,911,501 A * 6/1999 Katz ..... 362/353
6,152,582 A * 11/2000 Klaus ..... 362/363
6,502,962 B1 * 1/2003 Menke et al. ..... 362/439

* cited by examiner

*Primary Examiner*—Sandra O'Shea
*Assistant Examiner*—Ismael Negron
(74) *Attorney, Agent, or Firm*—Dennison, Schultz & Dougherty

(57) ABSTRACT

A bulb shade includes a light-transmissible hood portion having a bottom opening, a horizontal flange surrounding the bottom opening and a stepped shoulder close to the bottom opening, and a bulb-mounting seat provided with a connecting hole and a plurality of radiating holes and adapted to locate in the hood portion and abut on the stepped shoulder. A bulb base is detachably connected to the connecting hole on the bulb-mounting seat with a bulb connected thereto upward extended into the hood portion. The bulb shade may be directly connected to individual bulb base included in a light string to protect the bulbs thereof, or be attached to and extended into an inflatable toy of other type of decorative articles to isolate a decorative bulb in the bulb shade from the toy or the article.

4 Claims, 5 Drawing Sheets

BULB SHADE

BACKGROUND OF THE INVENTION

The present invention relates to a bulb shade, and more particularly to a bulb shade that allows a bulb to be detachably connect thereto to facilitate replacement of the bulb when necessary. The bulb shade may be connected to individual bulb in a light string or attached to and extended into an inflatable toy or other type of decorative article for a bulb to mount in the shade to shine the toy or the decorative article without direct contacting with the latter.

Light strings with flashing bulbs are frequently used as decorations in festivals, on advertising signboards, and in many other occasions to create warm and happy atmosphere usually by hanging them on walls, trees, signboards, etc. There are also small-sized light strings being provided inside inflatable toys and balloons to shine the same and thereby make the toys and balloons more attractive to people.

However, the use of conventional light strings inside inflatable toys and balloons has the following problems:

1. The bulbs included in the light strings are fixedly connected to the interior of the inflatable toys and balloons. Once the bulbs are burnt out or broken, they could not be replaced or repaired and are no longer useful in shining the inflatable toys and balloons.
2. In the event of a leaked inflatable toy or balloon or improperly mounted bulbs in the inflatable toy or the balloon, the inflatable toy or balloon would direct contact with the bulbs and very possibly be burned by the bulbs.

When the light string is used outdoors, it is usually fixed onto a wall surface or a tree by nails, adhesive tapes or some other clips, or is just freely spread over lawn. The bulbs are directly exposed to wind, rain and soil without being protected with any cover and are therefore subjected to damages and electrical leakage due to collision, moisture or trampling.

It is therefore tried by the inventor to develop a bulb shade to protect and facilitate replacement of the bulbs included in the light strings or attached to the inflatable toys and balloons, so that the light strings and the inflatable toys and the balloons are not influenced by any damaged bulbs and have prolonged usable life.

SUMMARY OF THE INVENTION

A primary object of the present invention is to provide a bulb shade adapted to attach to an inflatable toy or a balloon for a bulb to detachably mount in the bulb shade and shine the toy or balloon without direct contacting with the same, so that the inflatable toy or the balloon is not subject to burning due to any direct contact with the bulb and that a damaged bulb could be easily replaced or repaired without adversely influencing the usable life of the inflatable toy or the balloon.

Another object of the present invention is to provide a bulb shade adapted to use outdoors to cover and locate individual bulb in a light string, so that the light string is more attractive in appearance and safer for use.

To achieve the above and other objects, the bulb shade of the present invention mainly includes a light-transmissible hood portion and a bulb-mounting seat. The hood portion has a bottom opening, a horizontal flange surrounding the bottom opening, and a stepped shoulder close to the bottom opening. The bulb-mounting seat is provided with a connecting hole and a plurality of radiating holes and is adapted to locate in the hood portion to abut on the stepped shoulder. A bulb mounted on a bulb base is detachably connected to the connecting hole on the bulb-mounting seat to upward extend into the hood portion. The bulb shade may be directly connected to individual bulb base included in a light string to protect the bulbs thereof, or be attached to an inflatable toy of other type of decorative articles to separate a decorative bulb in the bulb shade from direct contacting with the toy or the decorative article. The inflatable toy or the decorative article is therefore protected against burning due to direct contact with the bulb.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
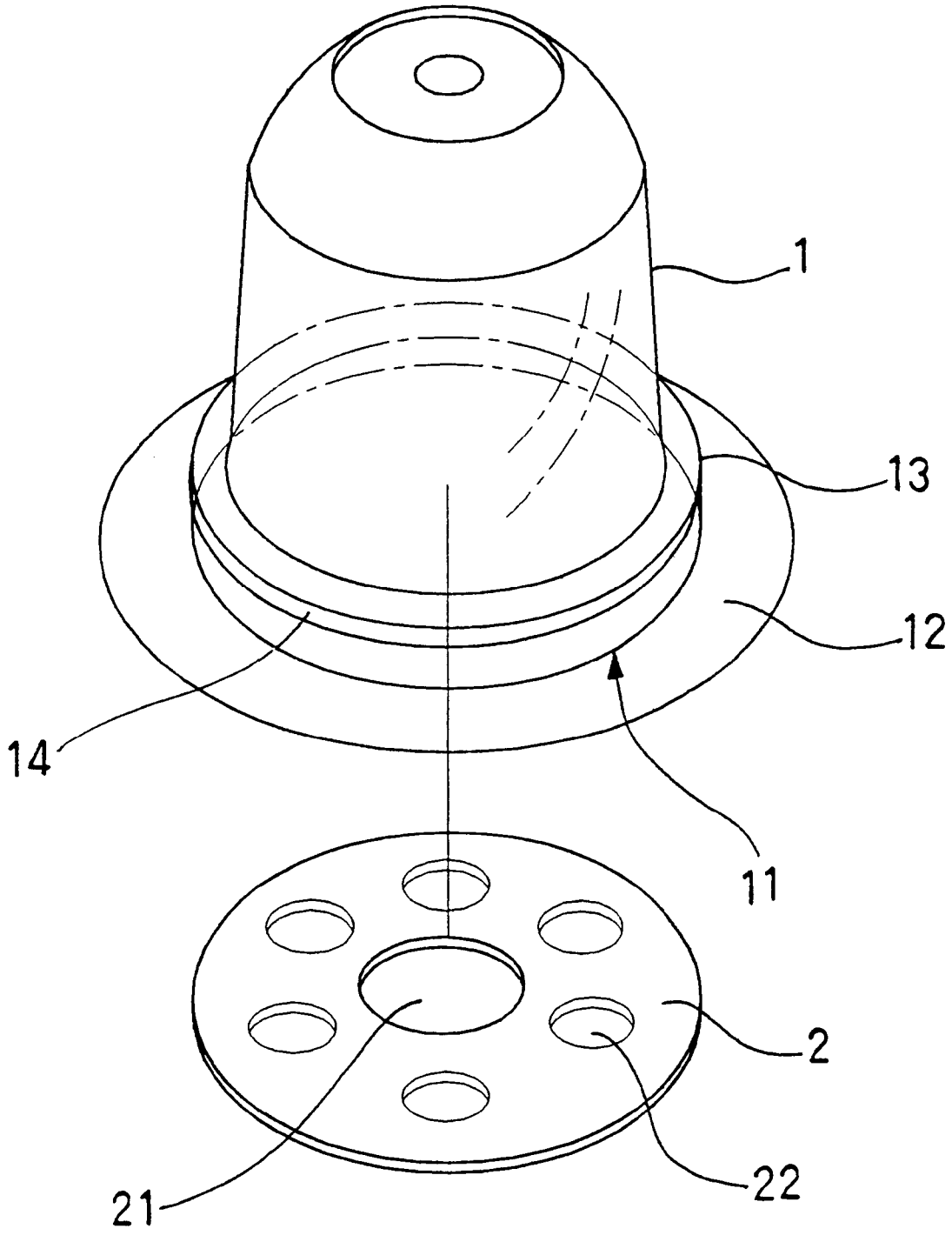
FIG. 1 is an exploded perspective of a bulb shade according to the present invention.
Figure 2:
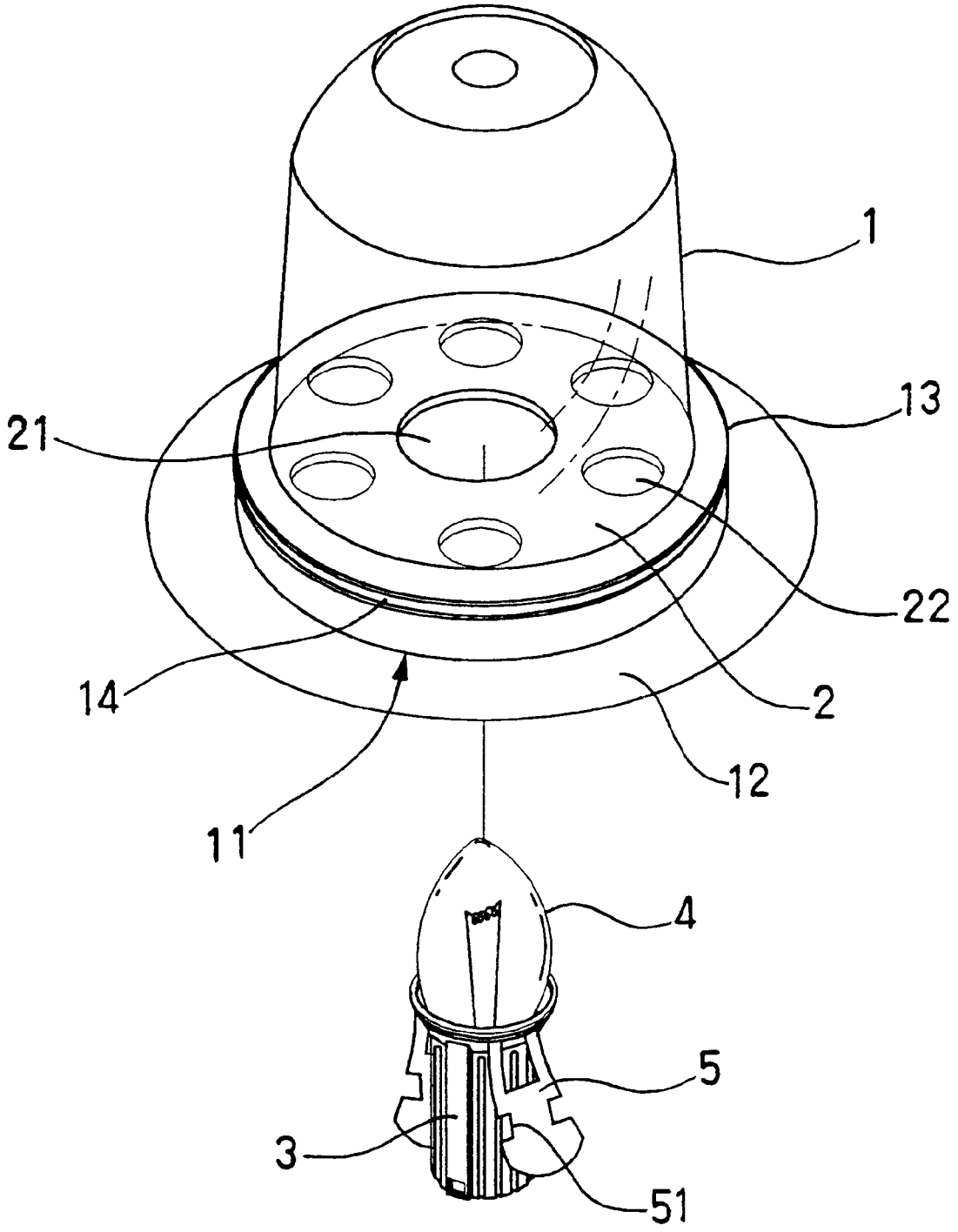
FIG. 2 is an assembled perspective of the bulb shade of FIG. 1 before a bulb is connected thereto.
Figure 3:
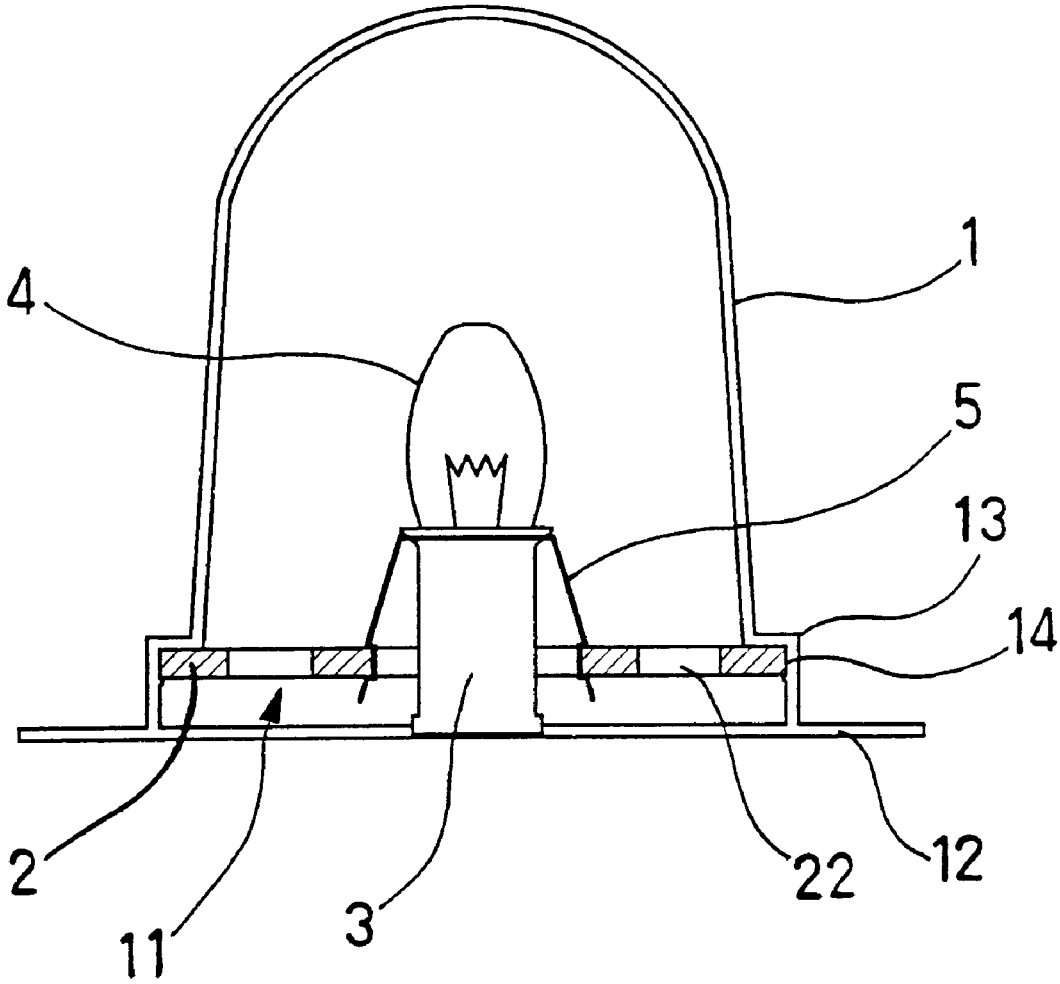
FIG. 3 is an assembled elevation of the bulb shade of FIG. 2 with a bulb connected thereto.

Please refer to FIGS. 1, 2 and 3 in which a bulb shade according to the present invention is shown. The bulb shade mainly includes a light-transmissible hood portion 1 and a bulb-mounting seat 2.

The light-transmissible hood portion 1 is an open-bottomed cylindrical member defining a bottom opening 11. A horizontal flange 12 radially outward extends from an outer periphery of the bottom opening 11 by a predetermined length. A lower part of the hood portion 1 adjacent to the bottom opening 11 has a stepped configuration, so that a limiting shoulder 13 is provided inside the hood portion 1 of the bulb shade.

The bulb-mounting seat 2 is dimensionally corresponding to the bottom opening 11, so that the bulb-mounting seat 2 is adapted to fitly locate in the hood portion 1 via the bottom opening 11 to abut on the limiting shoulder 13. An annular rib is provided around an inner wall of the hood portion 1, so that an annular groove 14 is formed immediately below the limiting shoulder 13. The annular groove 14 has height and depth just suitable for fitly holding an outer peripheral edge of the bulb-mounting seat 2 therein, so that the bulb-mounting seat 2 is normally securely located in the annular groove 14 in the hood portion 1 below the limiting shoulder 13. The bulb-mounting seat 2 is provided preferably at a central portion with a connecting hole 21 for a bulb base 3 to detachably mount therein and thereby connect to the bulb-mounting seat 2, and at areas surrounding the connecting hole 21 with a plurality of radiating holes 22 for effectively radiating heat produced by a bulb 4 connected to the bulb base 3 when the bulb 4 is lighted up.

The bulb base 3 for use with the bulb shade of the present invention is provided with elastic clamping arms 5, each of which has two notches 51 provided at two lateral sides thereof for an edge of the connecting hole 21 to pass therethrough and thereby detachably holding the entire bulb base 3 to the bulb-mounting seat 2 in the connecting hole 21.

Figure 4:
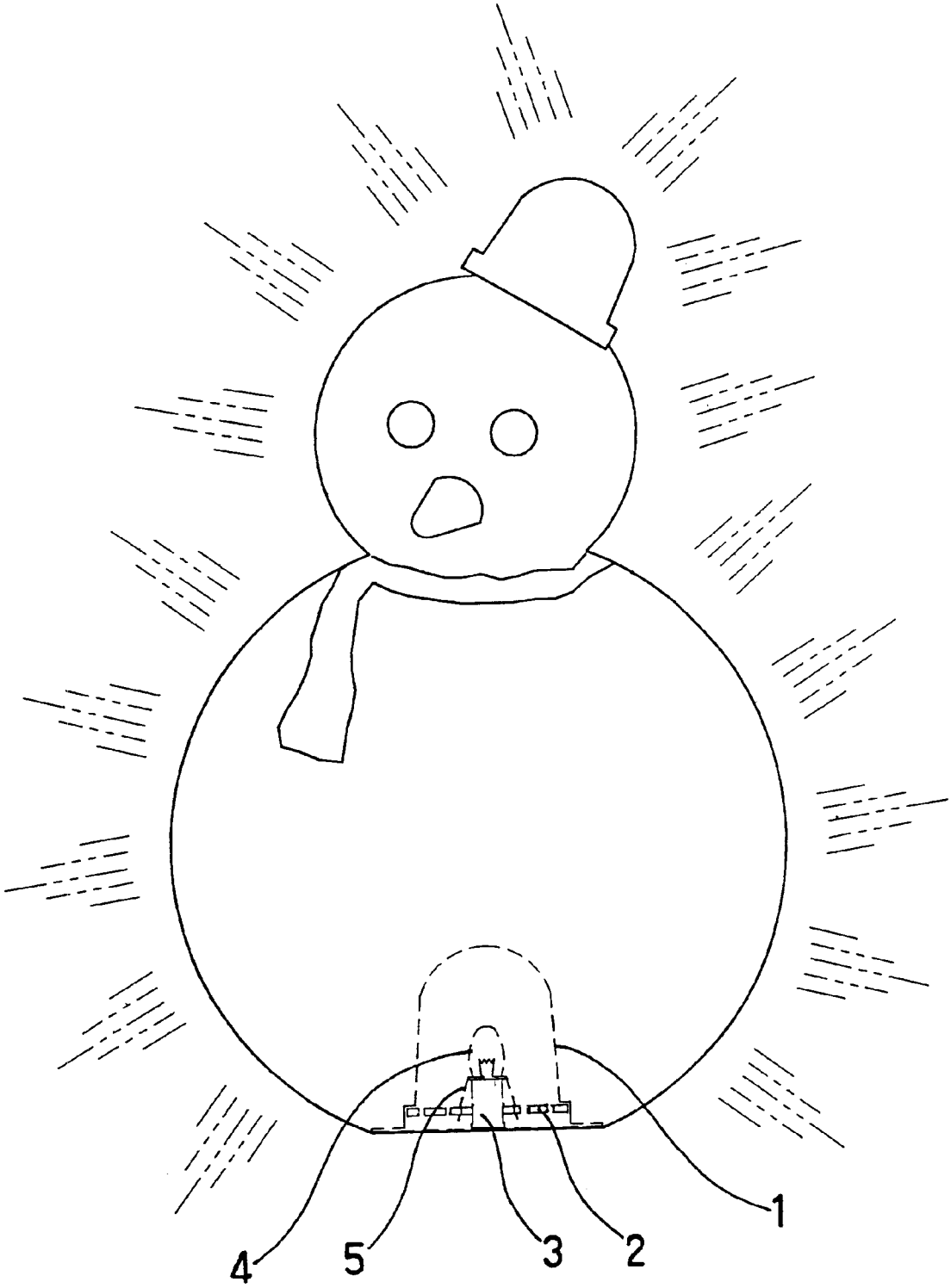
FIG. 4 illustrates the connection of the bulb shade of the present invention to an inflatable toy to isolate the toy from a bulb that shines the toy.

FIG. 4 shows the bulb shade of the present invention is attached to and extended into an inflatable toy 6. The bulb shade is connected in advance to the inflatable toy 6 by attaching the horizontal flange 12 surrounded the bottom opening 11 of the hood portion 1 to a desired position on the inflatable toy 6, so that the hood portion 1 is projected into an interior of the inflatable toy 6. Depending on a size of the inflatable toy 6, one or more hood portions 1 of the bulb shades may be attached to the inflatable toy 6 in the above-described manner.

When the inflatable toy 6 is not in use, the bulb-mounting seat 2 and the bulb base 3 with the bulb 4 may be stored at a separate place from the toy 6. And, to use and shine the inflatable toy 6, first position the bulb-mounting seat 2 into the annular groove 14 in the hood portion 1 via the bottom opening 11, and then align the bulb-base 3 with the connecting hole 21 on the bulb-mounting seat 2 and push it into the hood portion 1 so that the bulb 4 extends into the hood portion 1 and the notches 51 of the elastic clamping arms 5 on the bulb base 3 engage with the edge of the connecting hole 21 to securely hold the bulb base 3 in place. After the inflatable toy 6 is inflated, the hood portion 1 safely prevents the bulb 4 from direct contact with the toy 6. The bulb 4 would not contact with and burn the toy 6 when the bulb 4 is subjected to an external force and damaged or when the toy 6 leaks and deflates to contact with the hood portion 1. When the bulb 4 is lighted up and generates heat, the radiating holes 22 provided on the connecting seat 2 serve to effectively radiate the heat produced by the bulb 4. In the event the bulb 4 is damaged and needs replacement, simply disengage the clamping arms 5 of the bulb base 3 from the connecting hole 21 via the bottom opening 11 and pull the entire bulb base 3 out of the hood portion 1 and replace the burned bulb 4 with a new one. Thus, the inflatable toy 6 may have a prolonged usable life independent of the possibly damaged bulb 4. The bulb shade of the present invention may also be attached to differently shaped inflatable toys 6 and any other type of inflatable articles, such as balloons, as well as different decorative articles.

Figure 5:
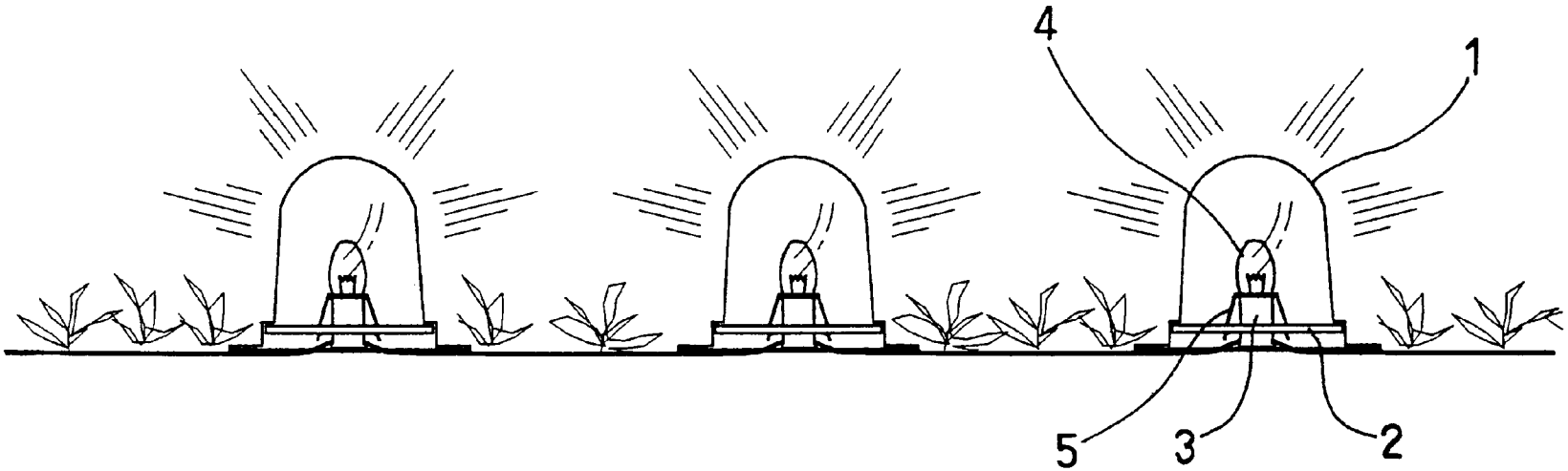
FIG. 5 illustrates the use of multiple bulb shades of the present invention to cover bulbs included in a decorative light string used outdoors.

The bulb shade of the present invention is not necessarily attached to an inflatable or decorative article. It may also be independently used with the bulb base 3 and the bulb 4 in outdoor decoration. For example, multiple bulb shades of the present invention may be directly connected to a plurality of serially connected bulb bases 3 in a light string for decorating walls, gardens, etc. as shown in FIG. 5. The bulb shades and the bulb bases 3 are connected to one another just in the same procedures described in the previous paragraph. The hood portions 1 give the light string a more beautiful appearance, and the horizontal flanges 12 facilitate fixing of the light string at the flanges 12 to predetermined positions, such as a wall surface or a ground surface. With the connecting hole 21 on the bulb-mounting seat 2, bulb bases 3 and bulbs 4 may be conveniently arranged to direct toward a uniform direction as desired. Through adequate design, the bulb base 3 may be connected to the bulb-mounting seat 2 in the hood portion 1 without contacting with the ground and can therefore avoid the risk of electrical leakage due to wet ground.

It is also possible to mount some small bulb bases of a light string in some of the radiating holes 22 on the bulb-mounting seat around the connecting hole 21 to make the light string and/or decorations with the light string more attractive.

In conclusion, the bulb shade of the present invention enables easy replacement of a damaged bulb connected thereto, so that an inflatable toy or a decorative article with the bulb shade is more safely and durable for use.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A bulb shade, comprising a light-transmissible hood portion and a bulb-mounting seat;

said light-transmissible hood portion being an open-bottomed member defining a bottom opening, a horizontal flange being provided around an outer periphery of the bottom opening to radially outward extend therefrom by a predetermined length, and a stepped shoulder being formed in a lower part of said hood portion adjacent to said bottom opening; and said bulb-mounting seat having a size corresponding to that of said bottom opening to fitly locate in said hood portion via said bottom opening to abut on said stepped shoulder; and said bulb-mounting seat being provided with a connecting hole for a bulb base to detachably mount therein; and said bulb shade being adapted to attach to an inflatable toy or other decorative article at a desired position to protect the toy or the article from direct contacting with and being burned by a bulb in the bulb shade, or to directly connect to said bulb base that is included in a light string used outdoors.

2. A bulb shade as claimed in claim 1, wherein said hood portion is an upward extended cylindrical member and has an annular rib provided around an inner wall so that an annular groove is formed immediately below said stepped shoulder and above said annular rib for holding a peripheral edge of said bulb-mounting seat, and wherein said bulb-mounting member is provided around said connecting hole with a plurality of radiating holes.

3. A bulb shade as claimed in claim 1, wherein said bulb base is provided with elastic clamping arms, each of which being provided at two lateral sides with two notches via which an edge of said connecting hole pass to hold said bulb base in place on said bulb-mounting seat.

4. A bulb shade as claimed in claim 2, wherein some of said radiating holes have said bulb bases mounted therein.

* * * * *